US009561422B1

(12) United States Patent
Csencsits et al.

(10) Patent No.: US 9,561,422 B1
(45) Date of Patent: Feb. 7, 2017

(54) GOLF SWING TRAINING APPARATUS

(71) Applicants: Mark Csencsits, Bethlehem, PA (US); Christopher Michael Albright, Allentown, PA (US)

(72) Inventors: Mark Csencsits, Bethlehem, PA (US); Christopher Michael Albright, Allentown, PA (US)

(73) Assignee: Fatt Matt LLC, Allentown, PA (US)

( * ) Notice: Subject to any disclaimer, the term of this patent is extended or adjusted under 35 U.S.C. 154(b) by 0 days.

(21) Appl. No.: 15/181,497

(22) Filed: Jun. 14, 2016

(51) Int. Cl.
*A63B 69/36* (2006.01)

(52) U.S. Cl.
CPC .... *A63B 69/3661* (2013.01); *A63B 2208/0204* (2013.01)

(58) Field of Classification Search
USPC ..... 473/219, 257, 264, 265, 278, 279
See application file for complete search history.

(56) References Cited

U.S. PATENT DOCUMENTS 3,018,109 A * 1/1962 Starck ..... A63B 69/3623 473/265
3,113,780 A * 12/1963 Livingstone ..... A63B 69/3623 403/122
4,786,057 A * 11/1988 Brown ..... A63B 69/36 473/265
5,205,562 A * 4/1993 Hammon ..... A63B 69/3661 156/72
2004/0253390 A1* 12/2004 Trafford ..... A41G 1/009 428/17
2008/0125237 A1* 5/2008 Avery ..... D05C 17/02 473/278

* cited by examiner

*Primary Examiner* — Nini Legesse
(74) *Attorney, Agent, or Firm* — Gregory Finch, Esq.

(57) ABSTRACT

A training aid for the game of golf capable of indicating golf club path through a swing and the club's point of contact at impact to a user. Embodiments of the present disclosure provide for a golf swing practice apparatus comprising a plurality of ball pins defining a movable golf ball hitting surface, each ball pin of the plurality of ball pins being comprised of a spherical ball joint, a ball tee portion running through a center portion of the spherical ball joint, and an artificial turf portion extending from an upper surface of the ball tee; a ball pin plate having a planar surface and a plurality of apertures disposed upon the planar surface in horizontal rows, the plurality of ball pins being movably coupled to the ball pin plate; and, a ball pin reset plate, the ball pin reset plate having a plurality of apertures being rectangular in shape and being slidably coupled to the ball pin plate.

18 Claims, 6 Drawing Sheets

GOLF SWING TRAINING APPARATUS

FIELD

The present disclosure relates to the field of golf training aids; in particular, an artificial golf practice surface that provides a visual indicator of club path and the club's point of contact at impact.

BACKGROUND

Regular practice is essential to achieving competency in the game of golf. Golfing centers offering the golfer hitting areas to practice and improve are highly popular. Such practice areas, often called driving ranges, employ artificial mats off of which a ball may be hit with a club. Unfortunately, many artificial golf hitting areas do not give the golfer a realistic feel to compare with hitting from turf or grass, and may even promote unsound techniques among certain golfers. Artificial surfaces may also increase the chance of injury to the golfer since they do not compress at the same rate as turf or grass.

In addition, golf ground shots require the golf club to be swung so that the head passes through the portion of the ball and ground surfaces so as to displace a portion of the turf similarly known as a "divot." Therefore, to approximate the feel of a natural fairway, artificial practice surfaces for ground shots should deform to allow the passage of the club head through the turf, and yet provide sufficient resistance to give the golfer the feel of taking a divot. A crucial component of mastering the game of golf is the ability to understand and correct flaws in a golfer's swing. One such flaw is an incorrect path of the golf club into impact. Another such flaw is hitting behind the ball, or hitting "fat", at the golfer's point of impact with the ball.

Previous artificial mats disclose solutions for suspendable portions that can move in response to a blow from a swing of the golf club. Such mats use springs, elastic, rubber bands or the like to provide a movable surface. Other golf mats have artificial turf surfaces made of belts that move along the same path along which the club head travels. These surfaces, however, have not solved the problem of simulating a realistic hitting surface and providing a visual indicator of club path and the club's point of contact at impact.

Through applied effort, ingenuity, and innovation, Applicant has identified a number of deficiencies and problems with artificial golf surfaces and training aids. Applicant has developed a solution that is embodied by the present invention, which is described in detail below.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a golf practice apparatus comprising a ball pin base plate, the ball pin base plate having a planar surface and having a plurality of apertures disposed upon the planar surface in horizontal rows; a plurality of ball pins movably coupled to the plurality of apertures on the base plate, each ball pin being comprised of a spherical ball joint, a ball tee portion running through a center portion of the spherical ball joint, and an artificial turf portion extending from an upper surface of the ball tee; and, a ball pin top plate, the ball pin top plate having a planar surface and having a plurality of apertures disposed upon the planar surface in horizontal rows corresponding to the ball pin base plate, the ball pin top plate being movably coupled to the plurality of ball pins such that the artificial turf portion of the plurality of ball pins extends through the plurality of apertures of the ball pin top plate.

Another object of the present disclosure is a golf swing practice apparatus comprising a plurality of ball pins defining a movable golf ball hitting surface, each ball pin of the plurality of ball pins being comprised of a spherical ball joint, a ball tee portion running through a center portion of the spherical ball joint, and an artificial turf portion extending from an upper surface of the ball tee; a ball pin plate having a planar surface and a plurality of apertures disposed upon the planar surface in horizontal rows, the plurality of ball pins being movably coupled to the ball pin plate; and, a ball pin reset plate, the ball pin reset plate having a plurality of apertures being rectangular in shape and being slidably coupled to the ball pin plate.

Yet another object of the present disclosure is a golf swing practice apparatus comprising a plurality of ball pins comprising a movable golf ball hitting surface, each ball pin of the plurality of ball pins being comprised of a spherical ball joint, a ball tee portion running through a center portion of the spherical ball joint, and an artificial turf portion extending from an upper surface of the ball tee; a ball pin plate having a planar surface and a plurality of apertures disposed upon the planar surface in horizontal rows, the plurality of ball pins being movably coupled to the ball pin plate; a ball pin guide plate having a plurality of apertures being triangular in shape, the plurality of apertures being in contact with the ball tee portion of the plurality of ball pins; and, a ball pin reset plate, the ball pin reset plate having a plurality of apertures being rectangular in shape and being slidably coupled to the ball pin plate.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
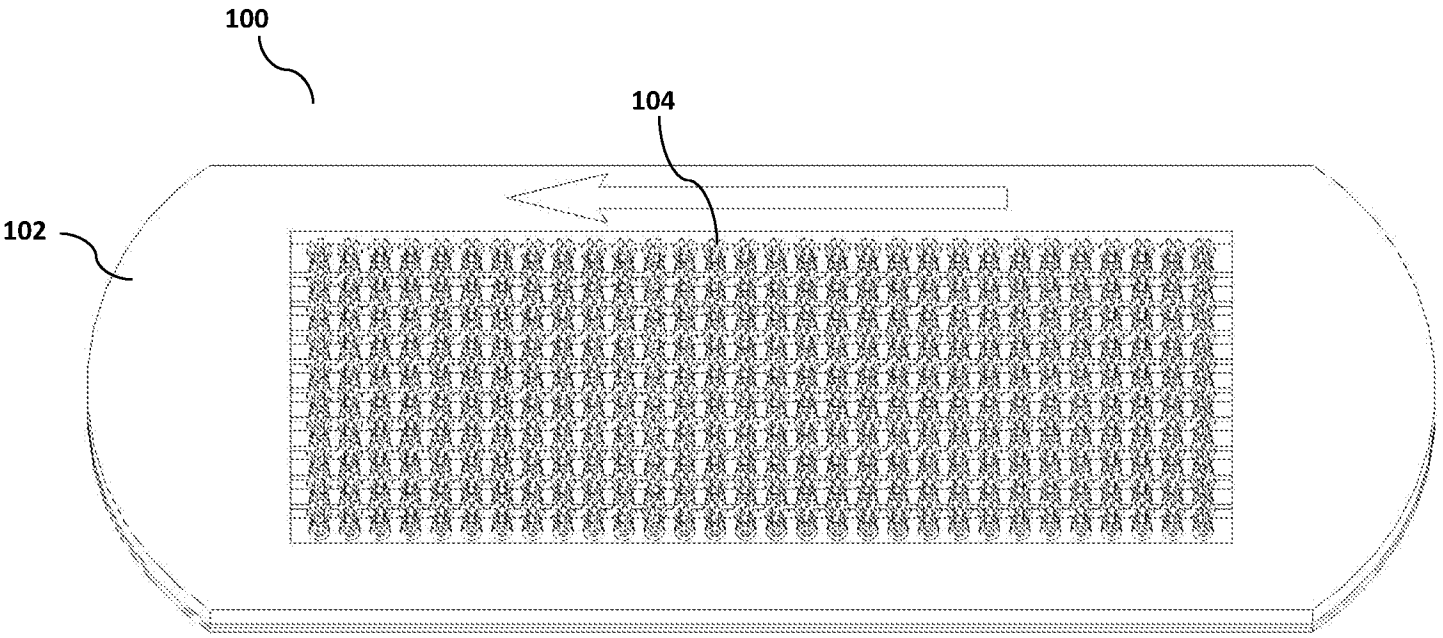
FIG. 1 is a perspective view of a golf swing training apparatus, according to an embodiment.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Embodiments of the present disclosure provide a training aid for the game of golf capable of indicating proper ball strike path and contact point to a user. Many golfers who practice on an artificial practice surface hit behind the golf ball, commonly referred to as striking the ball "fat." It is often difficult for golfers to detect when they have struck the ball in such a manner on artificial surfaces, since artificial surfaces do not create a divot as does striking a ball on real turf. Embodiments of the present invention enable the user to see where the contact point and path was made by the club in relationship to a golf ball, where impact was made with a golf ball, and the path of the leading edge of golf club through the impact zone of the golf ball. The present invention promotes the proper golfing technique of hitting the golf ball first and the surface in front of the ball second. Poor ball strikers tend to hit the surface behind the ball first and then the ball. In addition, hitting the ball only and not the hitting surface, commonly known as hitting the ball "thin," and is also not a proper technique. Embodiments of the present disclosure enable a user to see whether zero contact with the surface has been made to show whether a "thin" ball-only strike has been made.

Referring now to FIG. 1, a perspective view of a golf swing training apparatus is shown. According to an embodiment, a golf swing training apparatus 100 is comprised of a housing 102 and a plurality of ball pins 104. The housing 102 serves as a platform for the plurality of ball pins 104 and the other components of golf swing training apparatus 100, discussed below. The plurality of ball pins 104 defines an artificial hitting surface for a golf ball. Housing 102 may have an indicator such as an arrow to show the proper direction in which to swing the golf club when a golf ball is placed on the artificial hitting surface. Each of the ball pins 104 is configured to move independently in a range of motion of about 90 degrees to about 180 degrees. When a user is ready to utilize apparatus 100 for golf practice, the ball pins 104 are set to an upright position. When a user hits a golf ball, the pins 104 that the user comes in contact with the golf club head during the user's golf swing are displaced, thereby indicating the path of the golf club head through impact with the golf ball. This allows the user to evaluate whether he or she is hitting the golf ball first and the mat surface second, according to proper technique. The ball pins 104 are reset to an upright position between shots.

Figure 2:
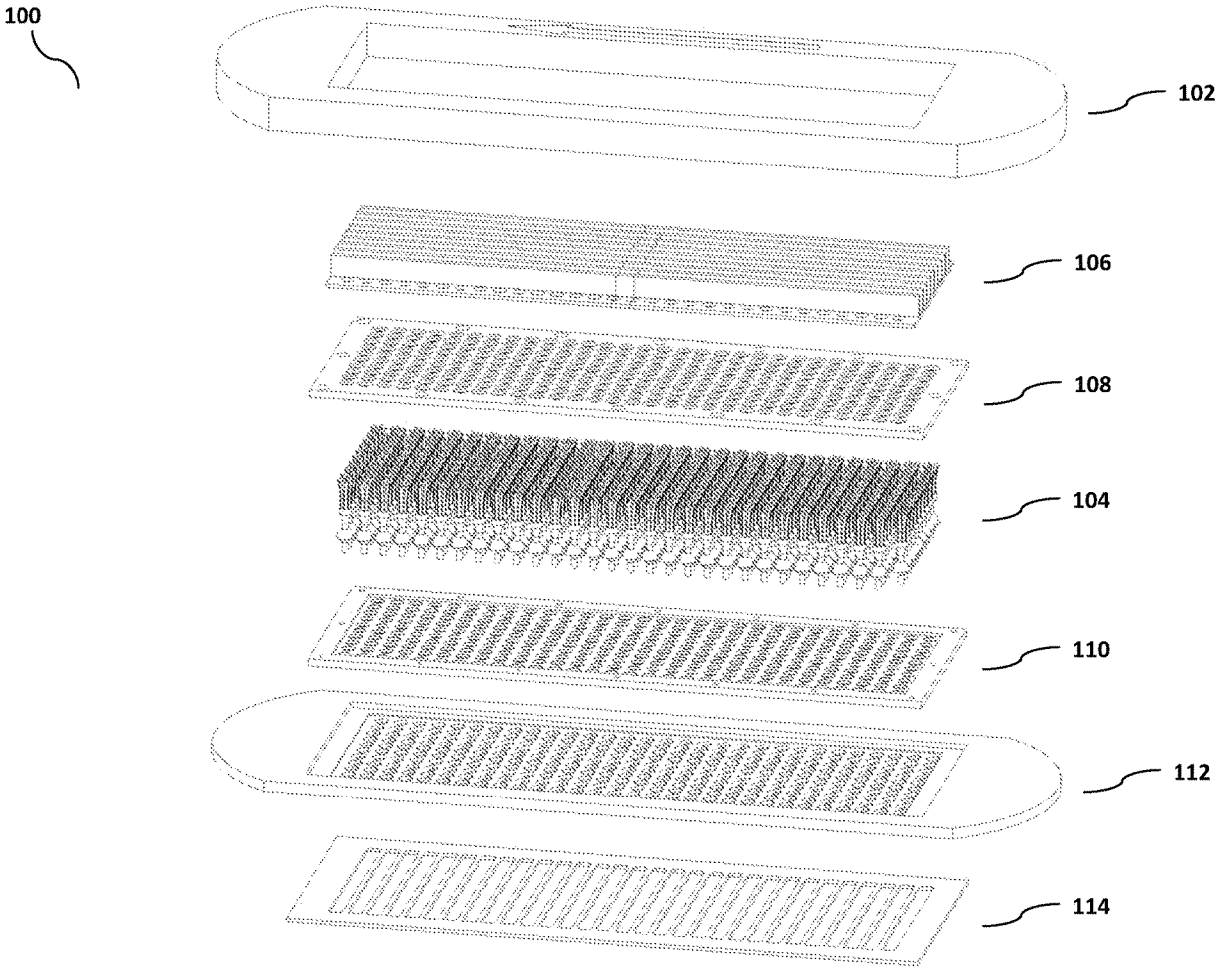
FIG. 2 is an exploded view of a golf swing training apparatus, according to an embodiment.

Referring now to FIG. 2, an exploded view of a golf swing training apparatus is shown. According to an embodiment, golf swing training apparatus 100 is comprised of housing 102, a strike guard 106, a ball pin top plate 108, ball pins 104, ball pin base plate 110, ball pin guide plate 112, and ball reset plate 114. Housing 102 may have side wall and a top defining an interior portion to house the other components of golf swing training apparatus 100. Strike guard 106 is configured to prevent a user from striking the club below an artificial turf portion of ball pin 104. Strike guard 106 may be comprised of a planar base portion and a plurality of vertical side walls extending from the planar base portion. The planar base portion may have a plurality of apertures to allow ball pins 104 to pass therethrough. An upper portion of the vertical side walls may be capped with rubber, plastic, or the like to define a shock absorbing layer to reduce risk of injury to the user when the user comes in contact with the vertical side walls when swinging a golf club. The height of the vertical side walls should be such that only the artificial turf portion of ball pins 104 extends above the vertical side walls. Ball pin top plate 108 and ball pin base plate 110 are configured to hold ball pins 104 in place, while still allowing ball pins 104 to rotate freely. Ball pin top plate 108 and ball pin base plate 110 may have a plurality of apertures configured such that an upper portion and lower portion of ball pins 104 may pass through ball pin top plate 108 and ball pin base plate 110, respectively, while holding in place a spherical ball joint of ball pins 104. When ball pin top plate 108 and ball pin base plate 110 are coupled around ball pins 104, ball pins 104 are securely held in place but remain capable of rotational movement. A ball pin guide plate 112 may function to restrict the range of motion of ball pins 104 such that they may only be displaced from an upright position in a range of motion of about 90 degrees to about 180 degrees relative to the direction of a golf club swing. Ball pin guide plate 112 may have a plurality of triangular or semi-circular shaped apertures configured to define a rotational boundary for a lower portion of ball pins 104. A ball pin reset plate 114 may be planar in shape and have a plurality of rectangular shaped apertures running in rows.

Figure 3:
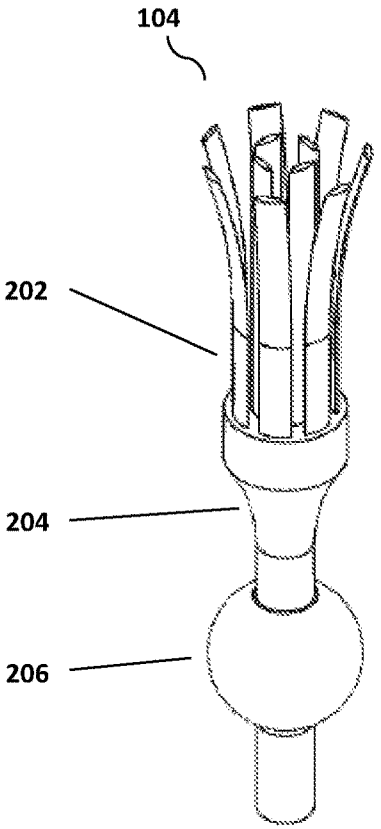
FIG. 3 is a perspective view of a ball pin of a golf swing training apparatus, according to an embodiment.

Referring now to FIG. 3, a perspective view of a ball pin 104 of a golf swing training apparatus is shown. According to an embodiment, ball pin 104 is comprised of an artificial turf portion 202, a tee portion 204, and a spherical ball joint portion 206. Tee portion 204 has an upper portion, to which artificial turf portion 202 is coupled, and a lower portion extending from spherical ball joint portion 206. Spherical ball joint portion 206 is disposed around tee portion 204. Artificial turf portion 202 may be made of rubber, plastic, felt, synthetic material and the like. According to an alternative embodiment, as shown in FIG. 4*b*, spherical ball joint portion 206 may be substituted for a cylindrical ball joint portion 206*b*. Cylindrical ball joint portion 206*b* may move about an axis such that ball pin 104*b* may be displaced in a forward direction according to the club path and club's point of contact at impact. By comparison, spherical ball joint portion 206 enables ball pin 104 to be displaced in a range of 360 degrees to visualize the club path and club's point of contact at impact.

Figure 4A:
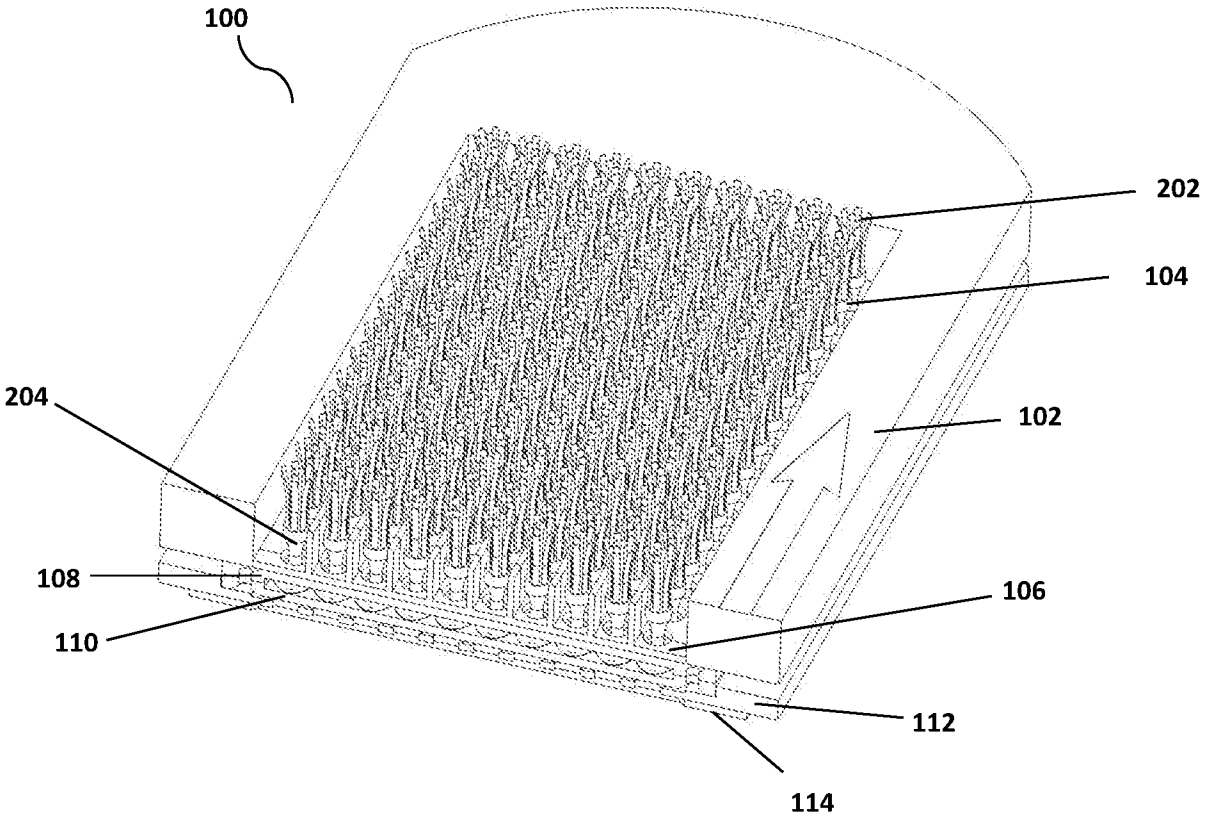
FIG. 4*a* is a cross sectional view of a golf swing training apparatus, according to an embodiment.
Figure 4B:
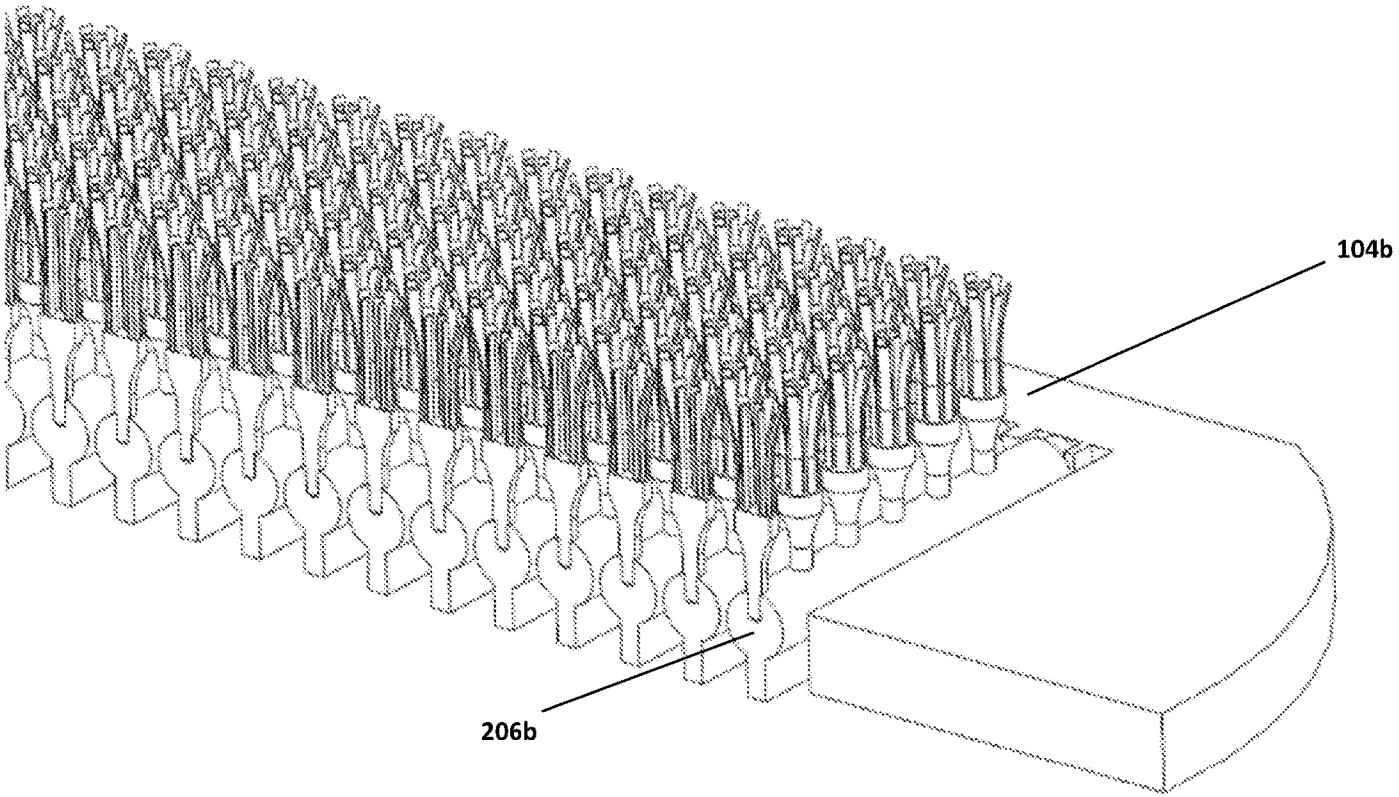
FIG. 4*b* is a cross sectional view of a golf swing training apparatus, according to an embodiment; and, FIG. 5 is a bottom up view of a golf swing training apparatus, according to an embodiment.
Figure 5:
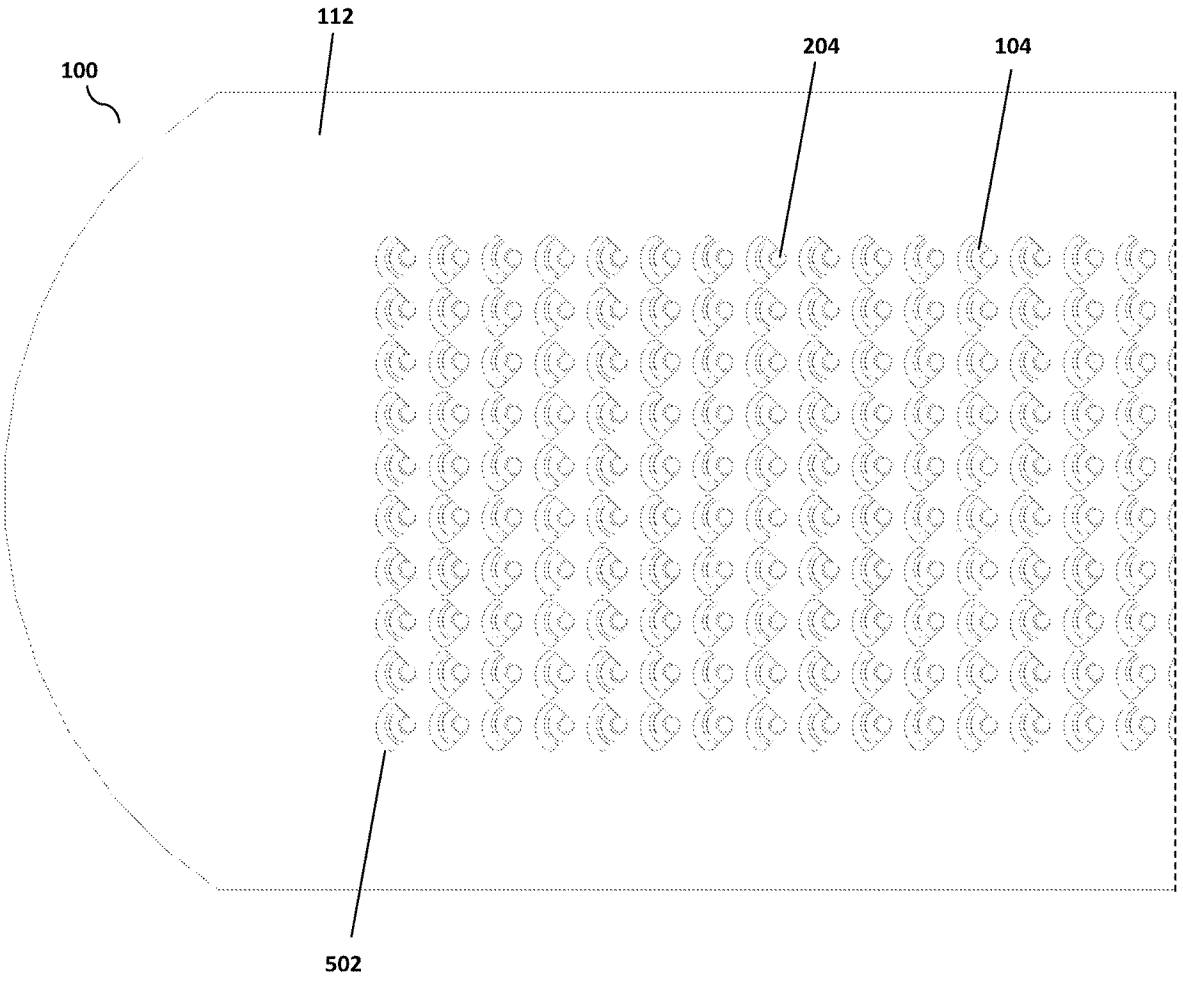

Referring now to FIG. 4, a cross sectional view of a golf swing training apparatus 100 is shown. Housing 102 is disposed upon ball pin top plate 108 and ball pin base plate 110. Ball pins 104 extend through ball pin top plate 108 and strike guard 106. The side walls of strike guard 106 are configured such that artificial turf portion 202 extends above the side walls. The plurality of ball pins 104 defines an artificial hitting surface for a user to strike the golf ball. When a user strikes the golf ball, pins 104 are displaced showing the path of the club head through impact with the golf ball. Ball pin guide plate 112 restricts the free motion of ball pins 104 such that ball pins 104 may only travel in the relative direction of the golf club head through the user's swing, and may be returned to an upright position by reset plate 114 after the user's swing. Reset plate 114 may be slidably coupled to ball pin guide plate 112 such that a user may laterally slide reset plate 114 to reset ball pins 104. Reset plate 114 functions to reset ball pins 104 by coming in contact with a lower portion of tee 204 when the user applies lateral force to reset plate 114, and pushing tee 204 into an upright position by coming in contact with a terminal portion of the triangular apertures in ball pin guide plate 112, as shown in FIG. 5. The user may apply lateral force to reset plate 114 through the use of a handle, level, lever, foot pedal and the like.

Referring now to FIG. 5, a bottom up view of ball pin guide plate 112 is shown. According to an embodiment, ball pin guide plate 112 has a plurality of rounded, triangular shaped apertures 502 that receive a lower portion of tee 204. When a user strikes a golf ball from the surface of golf swing training apparatus 100, ball pins 104 are displaces to show the user the path of the golf club head through impact with the golf ball. Apertures 502 limit the range of motion of ball pins 104 through impact with the golf club by coming in contact with a lower portion of tee 204. Ball pins 104 are returned to an upright position from being pushed by reset plate 114 (as shown in FIGS. 2 and 4).

Embodiments of the present disclosure enable the user to determine where a golf ball is struck when practicing on an artificial surface, and the path and impact point taken into and after impact with a golf ball resting on the artificial hitting surface. Alternative embodiments may employ a plurality of joints or ball and socket connections that act like synthetic grass and define an artificial hitting surface; and enable the artificial hitting surface to move and stay in position after a club has impacted a golf ball resting on the surface.

The user can use the invention according to a variety of use cases, practice locations and with or without golf balls. The portability of the invention makes it easy to use inside or outside. Embodiments of the invention may be utilized at a golf driving range, back yard, open field or an indoor golf facility or personal residence.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A golf practice apparatus comprising:

a ball pin base plate, the ball pin base plate having a planar surface and a plurality of apertures disposed upon the planar surface in horizontal rows;

a plurality of ball pins movably coupled to the plurality of apertures on the base plate, each ball pin being comprised of a ball joint, a ball tee portion running through a center portion of the ball joint, and an artificial turf portion extending from an upper surface of the ball tee; and, a ball pin top plate, the ball pin top plate having a planar surface and having a plurality of apertures disposed upon the planar surface in horizontal rows corresponding to the ball pin base plate, the ball pin top plate being movably coupled to the plurality of ball pins such that the artificial turf portion of the of the plurality of ball pins extends through the plurality of apertures of the ball pin top plate.

2. The golf practice apparatus of claim 1 further comprising a strike guard coupled to an upper surface of the ball pin top plate, the strike guard having a plurality of strike guard rails running parallel to the a plurality of apertures of the ball pin top plate.

3. The golf practice apparatus of claim 1 further comprising a housing disposed upon the ball pin base plate and the ball pin top plate, the housing having side walls and a top.

4. The golf practice apparatus of claim 1 further comprising a ball pin guide plate having a plurality of apertures being triangular in shape.

5. The golf practice apparatus of claim 1 further comprising a ball pin reset plate, the ball pin reset plate having a plurality of apertures being rectangular in shape.

6. The golf practice apparatus of claim 1 wherein the plurality of ball pins defines an artificial hitting surface for a golf ball.

7. The golf practice apparatus of claim 2 further comprising a housing disposed upon the ball pin base plate and the ball pin top plate, the housing having side walls and a top.

8. The golf practice apparatus of claim 7 further comprising a ball pin guide plate having a plurality of apertures being triangular in shape.

9. The golf practice apparatus of claim 8 further comprising a ball pin reset plate, the ball pin reset plate having a plurality of apertures being rectangular in shape.

10. A golf swing practice apparatus comprising:

a plurality of ball pins defining a movable golf ball hitting surface, each ball pin of the plurality of ball pins being comprised of a spherical ball joint, a ball tee portion running through a center portion of the spherical ball joint, and an artificial turf portion extending from an upper surface of the ball tee;

a ball pin plate having a planar surface and a plurality of apertures disposed upon the planar surface in horizontal rows, the plurality of ball pins being movably coupled to the ball pin plate; and, a ball pin reset plate, the ball pin reset plate having a plurality of apertures being rectangular in shape and being slidably coupled to the ball pin plate.

11. The golf practice apparatus of claim 10 further comprising a strike guard coupled to an upper surface of the ball pin plate, the strike guard having a plurality of strike guard rails running parallel to the plurality of apertures of the ball pin plate.

12. The golf practice apparatus of claim 10 further comprising a housing disposed upon the ball pin plate, the housing having side walls and a top.

13. The golf practice apparatus of claim 10 further comprising a ball pin guide plate having a plurality of apertures being triangular in shape.

14. The golf practice apparatus of claim 11 further comprising a housing disposed upon the ball pin plate, the housing having side walls and a top.

15. The golf practice apparatus of claim 14 further comprising a ball pin guide plate having a plurality of apertures being triangular in shape.

16. A golf swing practice apparatus comprising:

a plurality of ball pins defining a movable golf ball hitting surface, each ball pin of the plurality of ball pins being comprised of a spherical ball joint, a ball tee portion running through a center portion of the spherical ball joint, and an artificial turf portion extending from an upper surface of the ball tee;

a ball pin plate having a planar surface and a plurality of apertures disposed upon the planar surface in horizontal rows, the plurality of ball pins being movably coupled to the ball pin plate;

a ball pin guide plate having a plurality of apertures being triangular in shape, the plurality of apertures being in contact with the ball tee portion of the plurality of ball pins; and, a ball pin reset plate, the ball pin reset plate having a plurality of apertures being rectangular in shape and being slidably coupled to the ball pin plate.

17. The golf practice apparatus of claim 16 further comprising a strike guard coupled to an upper surface of the ball pin plate, the strike guard having a plurality of strike guard rails running parallel to the plurality of apertures of the ball pin plate.

18. The golf practice apparatus of claim 16 further comprising a housing disposed upon the ball pin plate, the housing having side walls and a top.

* * * * *